US007891433B2

(12) United States Patent
Vinson et al.

(10) Patent No.: US 7,891,433 B2
(45) Date of Patent: Feb. 22, 2011

(54) RESETTABLE ANTIEXTRUSION BACKUP SYSTEM AND METHOD

(75) Inventors: Justin P. Vinson, Houston, TX (US); Paul Madero, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/651,797

(22) Filed: Jan. 4, 2010

(65) Prior Publication Data

US 2010/0101804 A1 Apr. 29, 2010

Related U.S. Application Data

(63) Continuation of application No. 12/146,799, filed on Jun. 26, 2008.

(51) Int. Cl.
*E21B 33/128* (2006.01)
*E21B 23/06* (2006.01)

(52) U.S. Cl. ..... 166/387; 166/377; 166/196

(58) Field of Classification Search ..... 166/179, 166/196, 206, 216, 217, 387, 377; 277/339, 277/323

See application file for complete search history.

(56) References Cited

U.S. PATENT DOCUMENTS

| | | | | | |
|---|---|---|---|---|---|
| 2,337,733 | A | | 12/1943 | Burns et al. | |
| 2,555,647 | A | | 6/1951 | King | |
| 2,603,294 | A | | 7/1952 | Barnes | |
| 2,825,410 | A | | 3/1958 | Brown | |
| 3,061,013 | A | * | 10/1962 | Thomas, Jr. | 277/342 |
| 3,229,767 | A | * | 1/1966 | Carter | 166/134 |
| 3,292,938 | A | | 12/1966 | Tamplen | |
| 4,185,689 | A | * | 1/1980 | Harris | 166/133 |
| 5,226,492 | A | * | 7/1993 | Solaeche et al. | 166/196 |
| 5,261,492 | A | | 11/1993 | Duell et al. | |
| 5,271,468 | A | * | 12/1993 | Streich et al. | 166/387 |
| 5,701,954 | A | * | 12/1997 | Kilgore et al. | 166/119 |
| 6,536,532 | B2 | * | 3/2003 | Doane | 166/387 |
| 2006/0028917 | A1 | | 12/2006 | Conaway et al. | |

OTHER PUBLICATIONS

Petrowell Ltd, "Annulus Swellable Packer", Swelltec Expanding Packer Solutions, Dyce, Anerdeen; 2007; pp. 1-2.

* cited by examiner

*Primary Examiner*—Kenneth Thompson
(74) *Attorney, Agent, or Firm*—Cantor Colburn LLP

(57) ABSTRACT

A resettable antiextrusion system including a backup ring, a ramp in operable communication with the backup ring, and a gauge ring attached to the ramp. A method for sealing a tubular.

13 Claims, 6 Drawing Sheets

RESETTABLE ANTIEXTRUSION BACKUP SYSTEM AND METHOD

CROSS-REFERENCE TO RELATED APPLICATION

This is a continuation application of U.S. patent application Ser. No. 12/146,799 filed Jun. 26, 2008, the entire disclosure of which is incorporated herein by reference.

BACKGROUND

Annular seals are a common part of virtually all hydrocarbon recovery systems. Such seals come in many different configurations and ratings. Such seals are a necessary and important part of hydrocarbon recovery efforts and generally function well for their intended purposes. In situation where there is a high differential pressure across the seal however extrusion of the seal becomes a concern. Extrusion occurs axially when the seal is extruded through a small gap between the tubular at an inside surface of the seal and the tubular at the outside surface of the seal. The gap is there because in order to run a tubular into a casing, clearance is necessary. This is also the reason that a seal is needed in the first place. While many configurations have been created to limit the gap and improve extrusion resistance, the art is always receptive to alternative methods and particularly to configurations capable of accommodating higher pressure differentials.

SUMMARY

A resettable antiextrusion system including a backup ring, a ramp in operable communication with the backup ring, and a gauge ring attached to the ramp.

A method for sealing a tubular including compressing a resettable antiextrusion system including a backup ring, a ramp in operable communication with the backup ring, a gauge ring attached to the ramp, urging the backup ring along the ramp to gain a greater radial dimension than the gauge ring, deforming an element at the system into contact with the tubular adjacent the backup ring.

BRIEF DESCRIPTION OF THE DRAWINGS

Referring now to the drawings wherein like elements are numbered alike in the several Figures.

DETAILED DESCRIPTION

Figure 1:
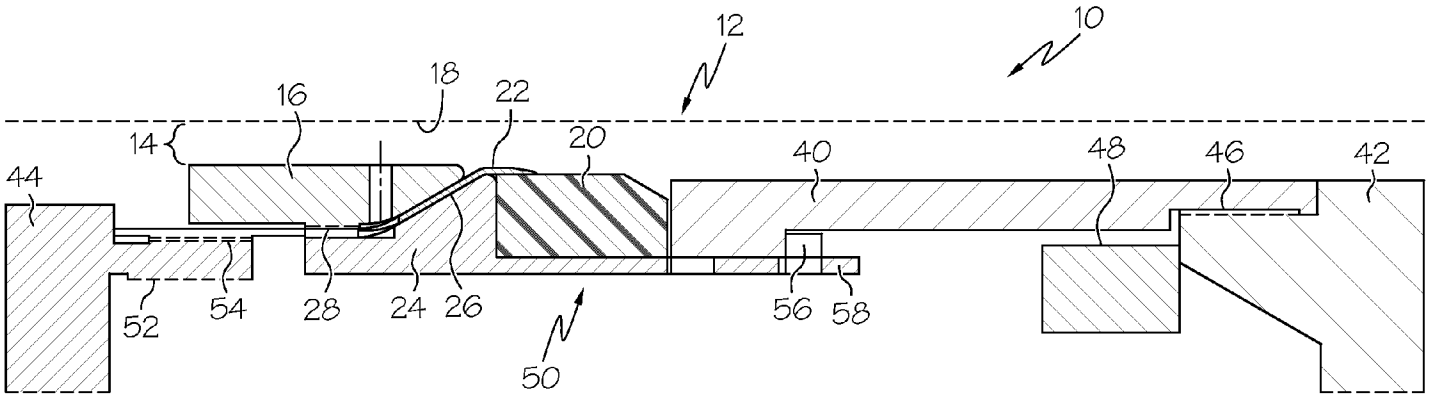
FIG. 1 is a cross section view of a resettable antiextrusion backup system in an unsealed condition.
Figure 2:
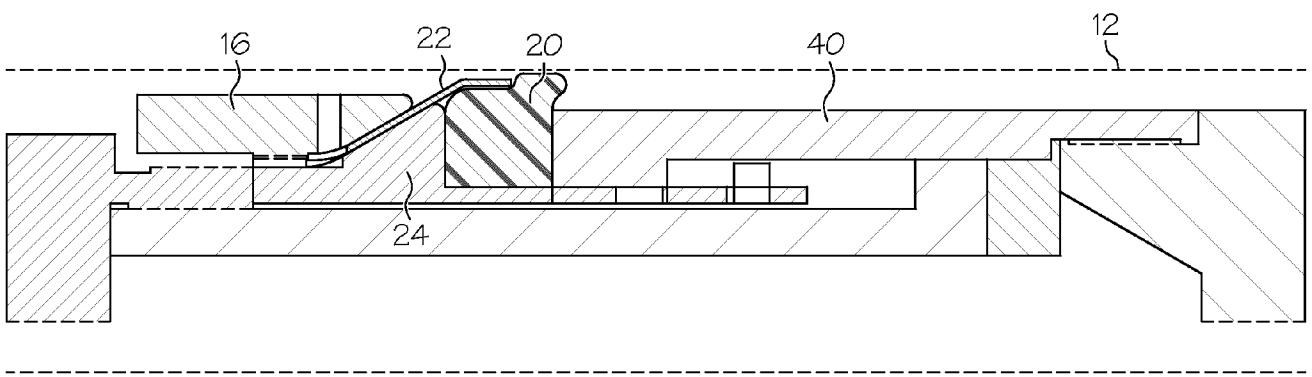
FIG. 2 is a cross section view of a resettable antiextrusion backup system in a sealed condition.

Referring to FIGS. 1 and 2 a cross section of a resettable antiextrusion backup system 10 is illustrated in an unset (FIG. 1) and set (FIG. 2) condition respectively. Focusing upon FIG. 1, the system 10 is illustrated in cross section within another tubular structure 12 such as a casing segment. It will be apparent that there is a clearance 14 between a gauge ring 16 and an inside surface 18 of the casing 12. This clearance is taken up by an element 20 when the system 10 is compressed. This is similar to prior art devices in that those devices cause an element to expand into contact with an inside surface of a tubular in which they are set but due to the size of the clearance, extrusion of such elements is possible. In the system disclosed herein, extrusion is prevented by a backup ring 22 that is displaceable to occupy the clearance space entirely. With the backup ring 22 in place, it is impossible for the element 20 to extrude in the direction of the backup ring 22. Advantageously, in the system disclosed, it is also possible to retract the backup ring 22 to an outside dimension less than that of the gauge ring 16. Moreover, setting and unsetting of the system 10 is possible for a great number of cycles.

In order to actuate the backup ring 22, a number of other components of the system 10 are utilized. A ramp 24 exhibits a frustoconical surface 26 that interacts with the backup ring 22 during axial compression of system 10 to cause the backup ring 22 to gain in radial dimension resulting in the backup ring spanning the entirety, in one embodiment, or at least a substantial portion of, in other embodiments, the clearance 14. In one embodiment the frustoconical surface 26 has an angle of about 40 to about 60 degrees and in a specific embodiment has an angle of about 50 degrees. In this position, the backup ring 22 effectively prevents extrusion of the element 20 due to differential pressure thereacross.

Figure 3:
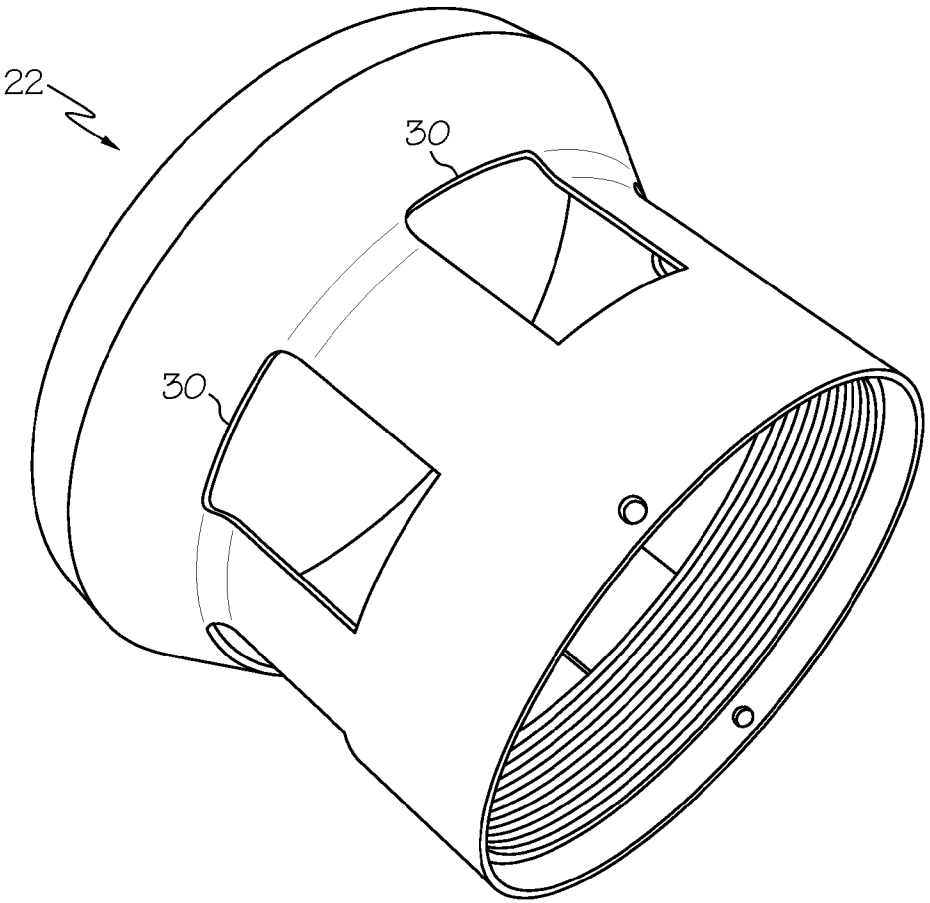
FIG. 3 is a perspective view of a backup ring as disclosed herein.
Figure 4:
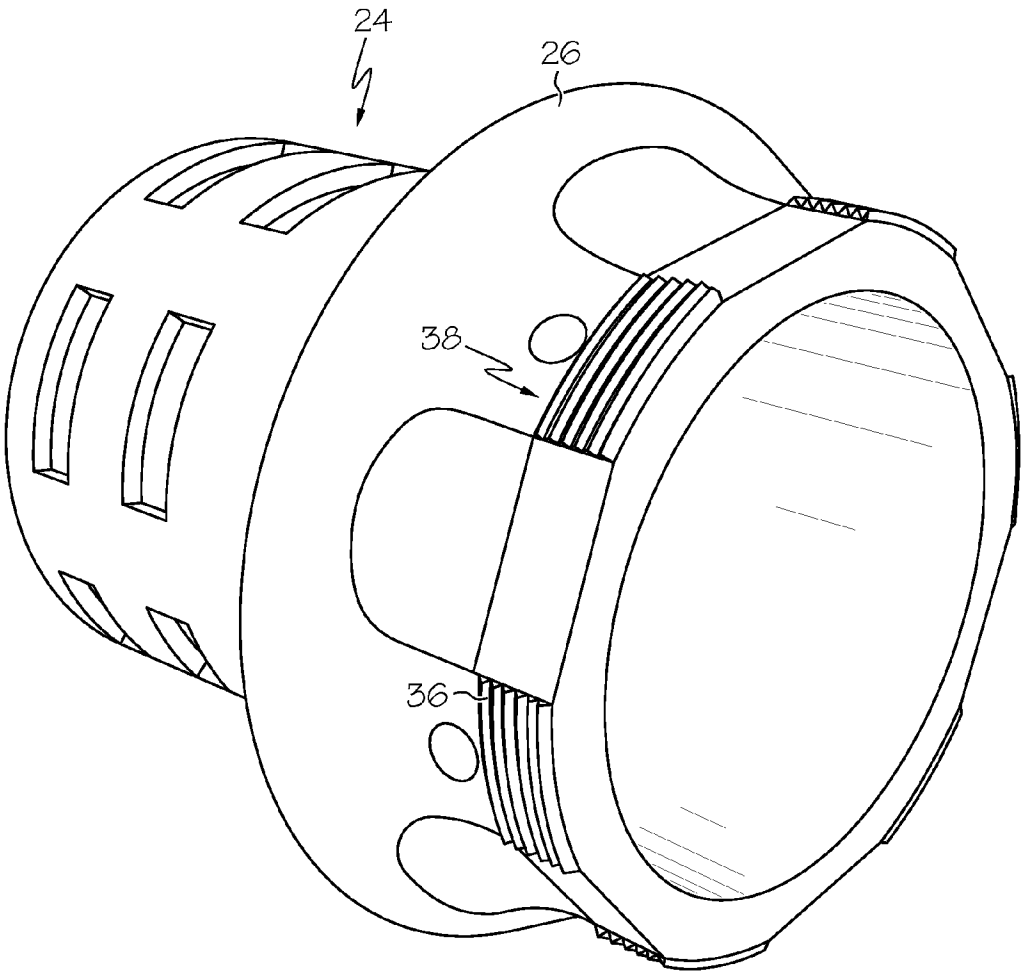
FIG. 4 is a perspective view of a ramp as disclosed herein.
Figure 5:
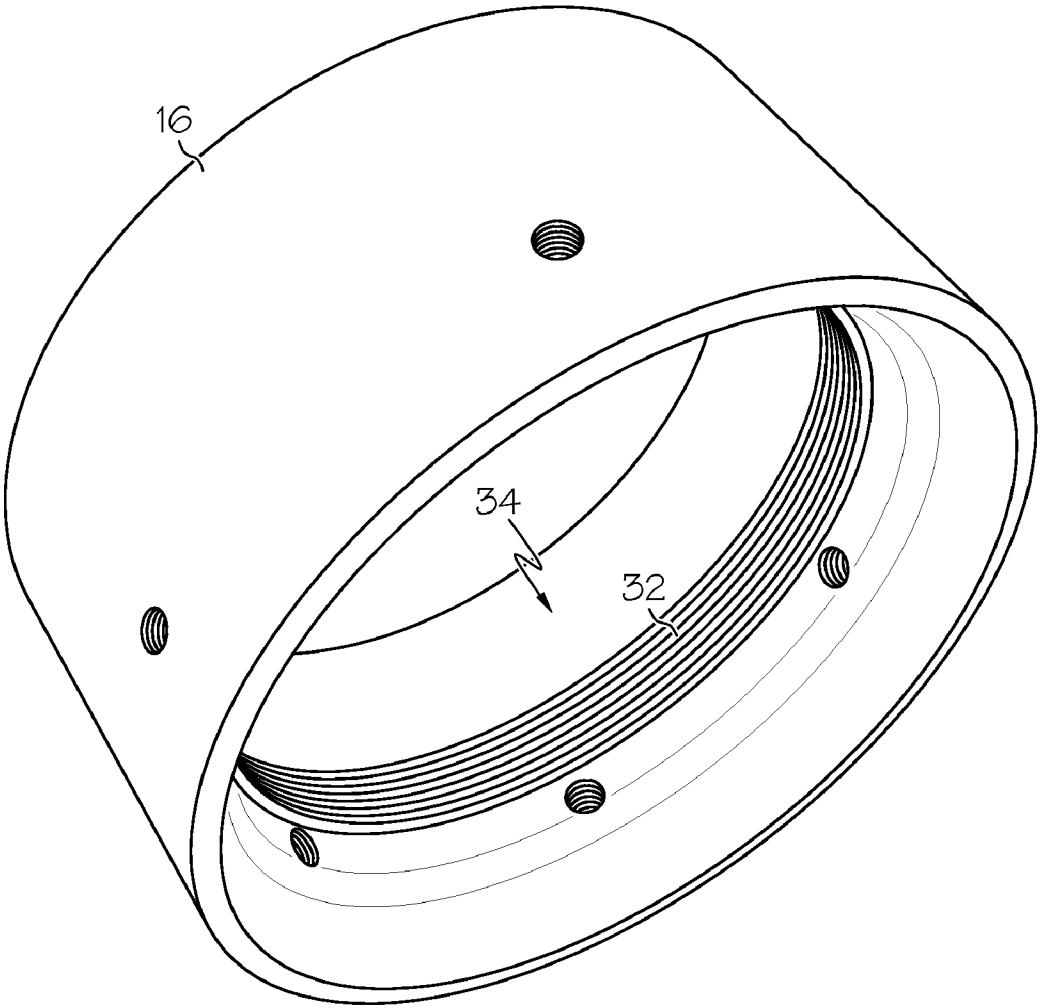
FIG. 5 is a perspective view of a gauge ring as disclosed herein.
Figure 6:
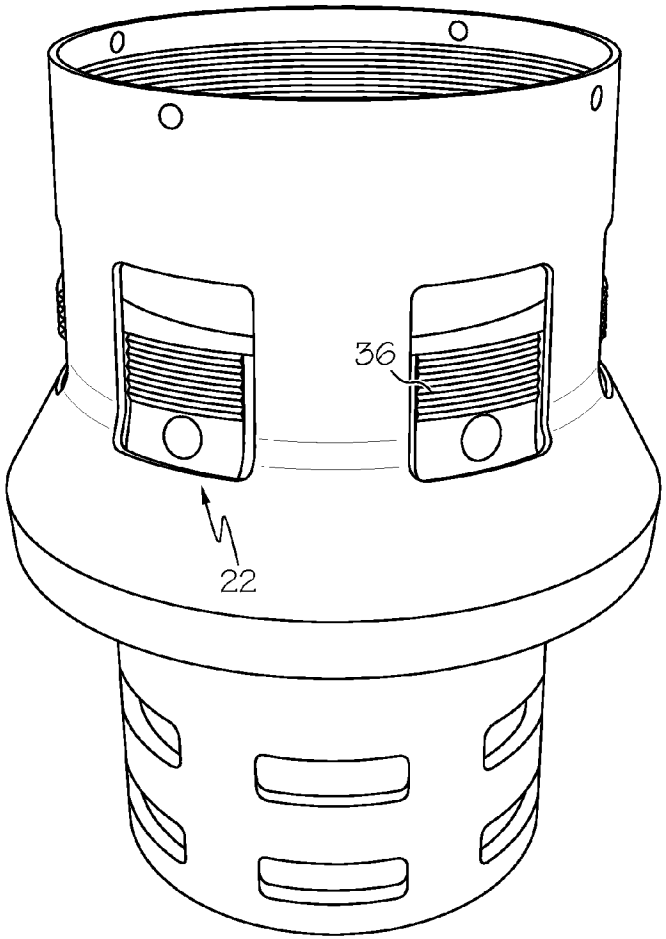
FIG. 6 is a perspective view of an assembly of FIGS. 3 and 4.
Figure 7:
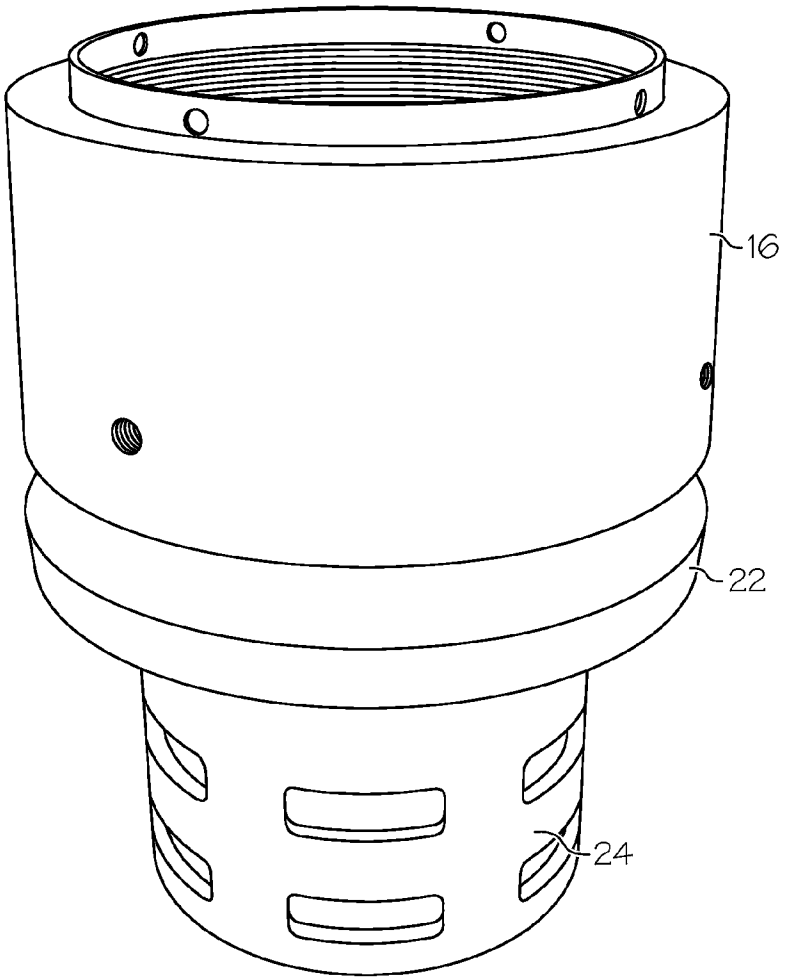
FIG. 7 is a perspective view of an assembly of FIGS. 3, 4 and 5.

The ramp 24 is fixedly connected at one or more connections 28 to the gauge ring 16 such that the ramp 24 and the gauge ring 16 always move together in an assembled system 10. In order to provide a greater understanding of the backup ring 22, ramp 24 and gauge ring 16, reference is made to FIGS. 3-7 in which is illustrated each one of these components in perspective view in FIGS. 3, 4, and 5 and then combinations of these components in FIGS. 6 and 7. The backup ring 22 includes one or more openings 30 that allow for the fixed connections 28 between the ramp 24 and the gauge ring 16. The fixed connections 28, in one embodiment hereof comprise a thread 32 at an inside surface 34 of the gauge ring 16 and a thread 36 at an outside surface 38 of the ramp 24. The two threads are complementary and engage one another through the openings 30 when the backup ring 22, ramp 24 and gauge ring 16 are assembled. It will be noted by the astute reader that the openings 30 are larger in the axial direction that the thread 36 is in the axial direction. This is to allow for axial movement of the backup ring 22 relative to the fixedly connected ramp 24 and gauge ring 16. Axial movement is provided to allow for the backup ring 22 movement up the frustoconical surface 26 of the ramp 24 which in turn causes the backup ring 22 to gain in radial dimension and fill the clearance 14. A review of FIGS. 6 and 7 will make the assembly clear to one of ordinary skill in the art.

Referring back to FIG. 1, the ramp is slidably in contact with a booster sleeve 40 that in turn is supported by more downhole components not germane to this disclosure but represented schematically by the structure identified with numeral 42. At an opposite end of the system 10 is another schematically represented structure 44 representing components more uphole of the system 10 which again are not germane to the disclosure. These two illustrated structures are only illustrated to show a structure to which certain components of the system 10 are attached. Booster Sleeve 40 is one such component of the system 10 and is attached to structure 42 via a thread 46. A spacer 48 is supported by the structure 42 in some embodiments to limit overall stroke of the system 10 to prevent damaging the element 20. Spacer 48 is sized to be contacted by a connector sleeve 50 that is itself fixedly connected to structure 44. This connection is via a thread 52 in one embodiment though any fixed connection could be substituted. Structure 44 is also fixedly connected to backup ring 22 at thread 54. Finally a retraction dog 56 is disposed in a slot 58 in ramp 24 to ensure that with a tensile load placed on system 10, the load is transferred to the Booster Sleeve 40 and subsequently reduces the radial dimension of the Back Up Ring 22 to an outside dimension less than the outside dimension of the Gage Ring 16.

In operation, the system 10 provides, as above noted, up to a full clearance 14 obstruction and upon unsetting, the backup ring 22 can be brought back to a sub gauge dimension. This is exceedingly beneficial to the art because it means that extrusion of seals can be reliably and effectively prevented while the system 10 can be repositioned in the wellbore without concern for becoming stuck or doing damage to other wellbore tools due to an antiextrusion configuration having an outside dimension greater that gauge size.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A resettable antiextrusion system comprising:

a backup ring having a plurality of radially oriented openings therein;

a ramp in operable communication with the backup ring; and a gauge ring attached to the ramp by threads on the gauge ring engaged with threads on the ramp, the threads meshing through the plurality of openings in the backup ring.

2. The resettable antiextrusion system as claimed in claim 1 wherein the threads on the gauge ring are on an inside diameter of the gauge ring.

3. The resettable antiextrusion system as claimed in claim 1 wherein the backup ring is axially moveable relative to the attached gauge ring and ramp.

4. The resettable antiextrusion system as claimed in claim 1 wherein the system further includes a connector sleeve to limit axial compression on the system.

5. The resettable antiextrusion system as claimed in claim 1 wherein the system further includes an element responsive to axial compression of the system and in contact with the backup ring.

6. A method for sealing a tubular comprising:

compressing a resettable antiextrusion system including a backup ring having a plurality of radially oriented openings therein;

a ramp in operable communication with the backup ring; and a gauge ring attached to the ramp by threads on the gauge ring engaged with threads on the ramp, the threads meshing through the plurality of openings in the backup ring;

urging the backup ring along the ramp to gain a greater radial dimension than the gauge ring;

deforming an element at the system into contact with the tubular adjacent the backup ring.

7. The method as claimed in claim 6 wherein the deforming is by compressing the element between the ramp and another structure in an axial direction of the system.

8. The method as claimed in claim 6 wherein the urging causes the backup ring to attain contact with the tubular.

9. A method for operating in a well comprising:

running a resettable antiextrusion system including a backup ring; a ramp in operable communication with the backup ring; and a gauge ring attached to the ramp into a well;

compressing the system to cause the backup ring to gain an outside radial dimension greater than a gauge dimension of the system;

compressing the system further to set an element against an inside surface of a tubular making up a part of the well; and applying a tensile load on the system to unset the element and withdraw the backup ring to a radial dimension less than that of the gauge dimension of the system.

10. The method as claimed in claim 9 further comprising:

moving the system from the set position of claim 9.

11. The method as claimed in claim 10 wherein the moving is retrieving the system from the well.

12. The method as claimed in claim 9 wherein the moving is repositioning the system within the well.

13. The method as claimed in claim 12 wherein the method further comprises resetting the system in the new position.

* * * * *